US009174769B1

(12) United States Patent
Zephir et al.

(10) Patent No.: US 9,174,769 B1
(45) Date of Patent: Nov. 3, 2015

(54) VENTILATED LAUNDRY BASKET

(75) Inventors: Edward Zephir, Leominster, MA (US); David E. Zephir, Westminster, MA (US); Ronald M. Audet, North Smithfield, RI (US)

(73) Assignee: United Comb + Novelty Corporation, Leominster, MA (US)

( * ) Notice: Subject to any disclaimer, the term of this patent is extended or adjusted under 35 U.S.C. 154(b) by 0 days.

(21) Appl. No.: 13/542,713

(22) Filed: Jul. 6, 2012

Related U.S. Application Data

(60) Provisional application No. 61/504,759, filed on Jul. 6, 2011.

(51) Int. Cl.
*B65D 6/08* (2006.01)
*B65D 21/00* (2006.01)

(52) U.S. Cl.
CPC ..... *B65D 21/00* (2013.01)

(58) Field of Classification Search
CPC ..... B65D 77/0466; B65D 21/046; B65D 21/006; B65D 19/04; B65D 19/40; B65D 2519/00621; B65D 1/38; B65D 11/1846; B65D 71/0096; B65D 21/00
USPC ..... 220/485, 9.1, 913, 676, 4.03, 287, 220/908.3, 9.4, 23.86, 636, 608, 601, 220/495.04, 910, 675, 17.3, 626, 628, 637; 206/507, 504, 503, 315.9, 505, 206/515–520; 215/10; 150/154, 159; 190/103, 110; 217/76, 122, 124; 141/337, 338, 391; 2/16; 193/25 R
See application file for complete search history.

(56) References Cited

U.S. PATENT DOCUMENTS

| | | | | | |
|---|---|---|---|---|---|
| 689,093 | A | * | 12/1901 | Kestenbaum | 220/636 |
| 3,348,729 | A | * | 10/1967 | Ettlinger, Jr. | 220/676 |
| 3,438,544 | A | * | 4/1969 | Cloyd | 206/596 |
| 3,754,645 | A | * | 8/1973 | Kilroy | 206/596 |
| 4,438,856 | A | * | 3/1984 | Chang | 215/12.1 |
| 4,744,464 | A | * | 5/1988 | Noe | 206/422 |
| 4,880,126 | A | * | 11/1989 | Anderson | 215/386 |
| 4,890,760 | A | * | 1/1990 | Nicoll et al. | 220/495.04 |
| 5,069,344 | A | * | 12/1991 | Dehart | 206/508 |
| D327,560 | S | | 6/1992 | Hradisky | |
| 5,242,074 | A | * | 9/1993 | Conaway et al. | 220/840 |
| 5,312,013 | A | * | 5/1994 | Bridges | 220/625 |
| D350,423 | S | | 9/1994 | Craft, Jr. et al. | |
| D351,266 | S | | 10/1994 | Licari | |
| 5,372,257 | A | * | 12/1994 | Beauchamp et al. | 206/504 |
| 5,549,215 | A | * | 8/1996 | Cruce et al. | 220/676 |
| 5,671,858 | A | | 9/1997 | Hsu | |
| 5,678,717 | A | | 10/1997 | Hsu | |

(Continued)

*Primary Examiner* — Anthony Stashick
*Assistant Examiner* — James M Van Buskirk
(74) *Attorney, Agent, or Firm* — Brian M. Dingman; Dingman, McInnes + McLane, LLP

(57) ABSTRACT

A one-piece molded basket with a bottom defining an outer periphery and an inner section that defines a number of openings and is interior to, and at least substantially surrounded by, the outer periphery. The outer periphery is constructed and arranged to rest on a relatively flat surface and some or all of the inner section is located above the bottom of the outer periphery such that the inner section is above the flat surface when the outer periphery is on the flat surface. There are one or more indented vent channels that extend through the outer periphery and lead to the inner section, to allow air to pass through the outer periphery, a top rim, and a sidewall contiguous with and extending between the bottom and the top rim.

10 Claims, 14 Drawing Sheets

(56) References Cited

U.S. PATENT DOCUMENTS

| | | | | |
|---|---|---|---|---|
| 5,735,431 | A * | 4/1998 | LeTrudet | 220/639 |
| 5,752,602 | A * | 5/1998 | Ackermann et al. | 206/507 |
| 6,134,832 | A * | 10/2000 | Bokmiller et al. | 47/66.1 |
| 6,708,835 | B1 * | 3/2004 | Mathis | 220/4.03 |
| 7,097,062 | B2 | 8/2006 | DeRosa | |
| 7,207,460 | B2 | 4/2007 | Sander et al. | |
| 7,431,312 | B2 * | 10/2008 | Sebastian et al. | 280/33.998 |
| D584,020 | S | 12/2008 | McNamara | |
| 7,472,799 | B2 * | 1/2009 | Cadiente et al. | 220/366.1 |
| 7,784,615 | B2 * | 8/2010 | Stahl | 206/511 |
| 8,253,016 | B1 * | 8/2012 | Baldwin et al. | 174/50 |
| 2010/0300908 | A1 * | 12/2010 | Anderson | 206/315.3 |

* cited by examiner

400

470
452
450
460
461
464
480
451
463
462
453

VENTILATED LAUNDRY BASKET

CROSS REFERENCE TO RELATED APPLICATION

This application claims priority of Provisional Patent Application Ser. No. 61/504,759 filed on Jul. 6, 2011, the disclosure of which is incorporated by reference herein.

FIELD

This disclosure relates to ventilated laundry baskets, hampers and other similar containers.

BACKGROUND

Laundry baskets and hampers are available in multiple shapes (e.g., round, oval, rectangular), sizes and materials (e.g., plastic, wicker, rubber, cloth). Plastic laundry baskets and hampers are popular because they can handle damp or wet clothing and are easy to clean. Unlike wicker or cloth baskets or hampers, however, plastic baskets and hampers do not allow ambient air to freely circulate through the contents. As a result, plastic baskets and hampers are likely to harbor unpleasant odors, and are prone to mold and mildew.

To address this issue, some plastic laundry baskets and hampers include holes or openings for air flow, typically in the sides or the top of the basket. In some cases, holes or openings are included in the bottom of the basket. However, when the basket or hamper is placed on a floor or table, these openings in the bottom of the basket are blocked, restricting air circulation. There is a need in the art for a laundry basket or hamper with improved ventilation capabilities.

SUMMARY

Featured herein is a basket or hamper (i.e., a container) designed to hold laundry or other bulk objects in the home. The basket is designed to promote circulation of ambient air through the contents of the basket, even when the basket is placed on a floor or other relatively flat surface.

This disclosure features a one-piece molded basket with a bottom defining an outer periphery and an inner section that has a number of openings and is interior to, and at least substantially surrounded by, the outer periphery. The outer periphery is constructed and arranged to rest on a relatively flat surface and the inner section is located above the bottom of the outer periphery such that some or all of the inner section is above the flat surface when the outer periphery is on the flat surface. There are one or more indented vent channels that extend through the outer periphery and lead to the inner section, to allow air to pass through the outer periphery.

The inner section may define one or more ribs that extend from the approximate center of the bottom, and at least one vent channel may be radially aligned with at least one of the ribs. The basket may further comprise a plurality of feet extending downward from the inner section. The feet may extend downward to a point such that their lowermost extent is at about the same level as the lowermost extent of the outer periphery. The outer periphery may define a rounded outer contour. The vent channels may define a generally flat top.

The vent channels may be generally linear. The vent channels may be generally perpendicular to the portion of the outer periphery through which they pass. The vent channels may define an upper surface that lies above the upper surface of the outer periphery. The vent channels may be generally shaped as an inverted "U". The vent channels may define generally vertical sidewalls and a generally flat top. The outer periphery may define a generally rectangular shape with two generally parallel long sides and two generally parallel short sides, and there may be at least two vent channels in each long side. In one example, none of the vent channels are co-linear.

Featured in a more specific example is a one-piece molded basket with a bottom defining an outer periphery and an inner section that is interior to, and at least substantially surrounded by, the outer periphery. The inner section has a number of openings. The outer periphery is constructed and arranged to rest on a relatively flat surface and some or all of the inner section is located above the bottom of the outer periphery such that the inner section is above the flat surface when the outer periphery is on the flat surface. There are a plurality of indented generally linear vent channels that extend through the outer periphery and lead to the inner section and are generally perpendicular to the portion of the outer periphery through which they pass, wherein the vent channels are generally shaped as an inverted "U" and define an upper surface that lies above the upper surface of the outer periphery. A plurality of feet extend downward from the inner section to a point such that their lowermost extent is at about the same level as the lowermost extent of the outer periphery. There is a top rim and a sidewall contiguous with and extending between the bottom and the top rim.

The outer periphery may define a rounded outer contour. The vent channels may define a generally flat top. The vent channels may define generally vertical sidewalls, or inwardly canted sidewalls such that the contour is tapered. The outer periphery of the container may define a generally rectangular shape with two generally parallel long sides and two generally parallel short sides, and there may be at least two vent channels in each long side. In one example, none of the vent channels are co-linear.

DETAILED DESCRIPTION

Figure 1:
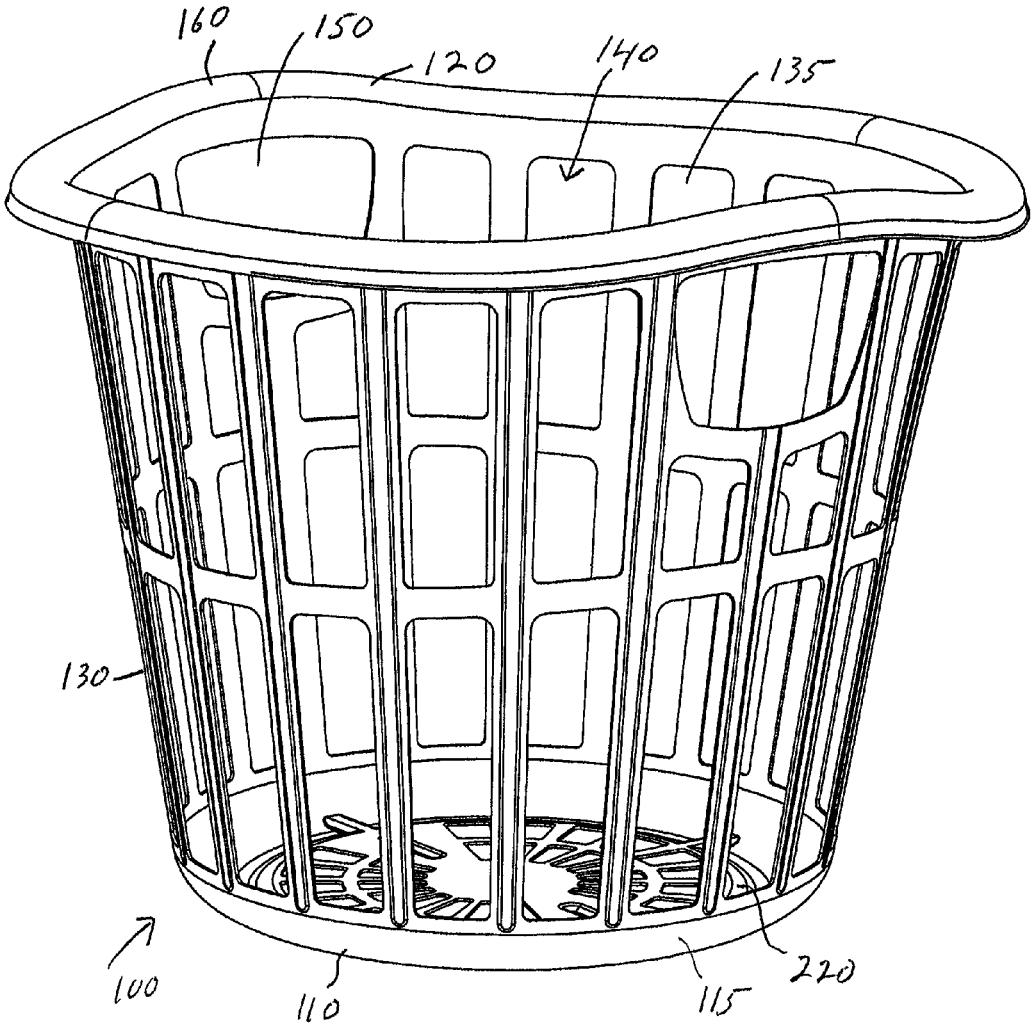
FIG. 1 is a perspective view of an example of a container of this disclosure.
Figure 2A:
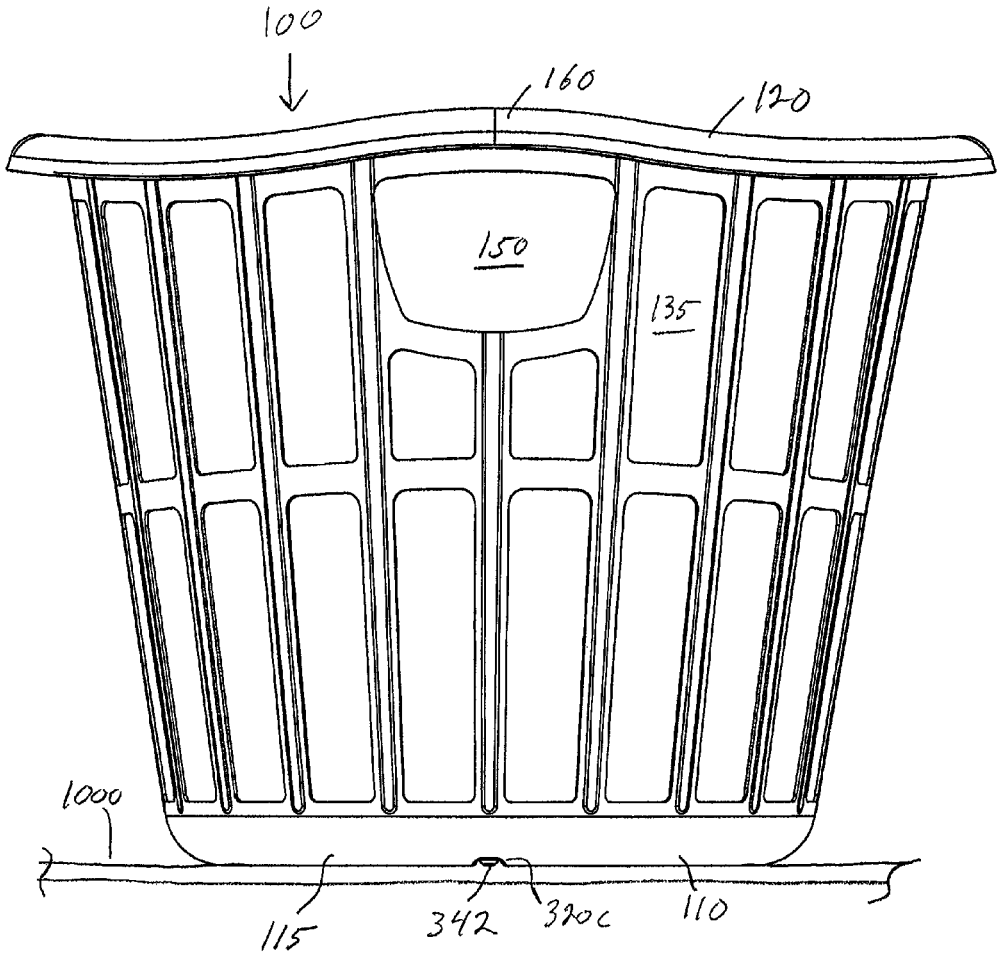
FIG. 2A is a left side view and FIG. 2B a front view of the container of FIG. 1.
Figure 2B:
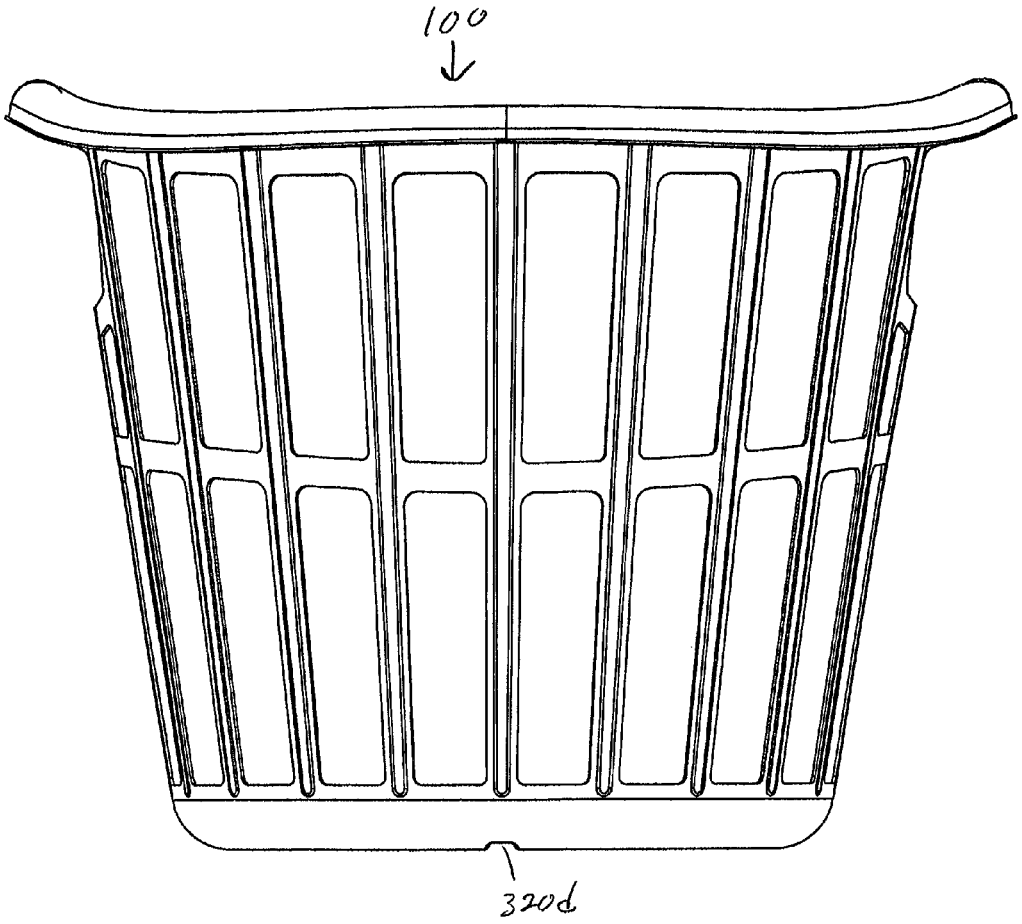
Figure 3A:
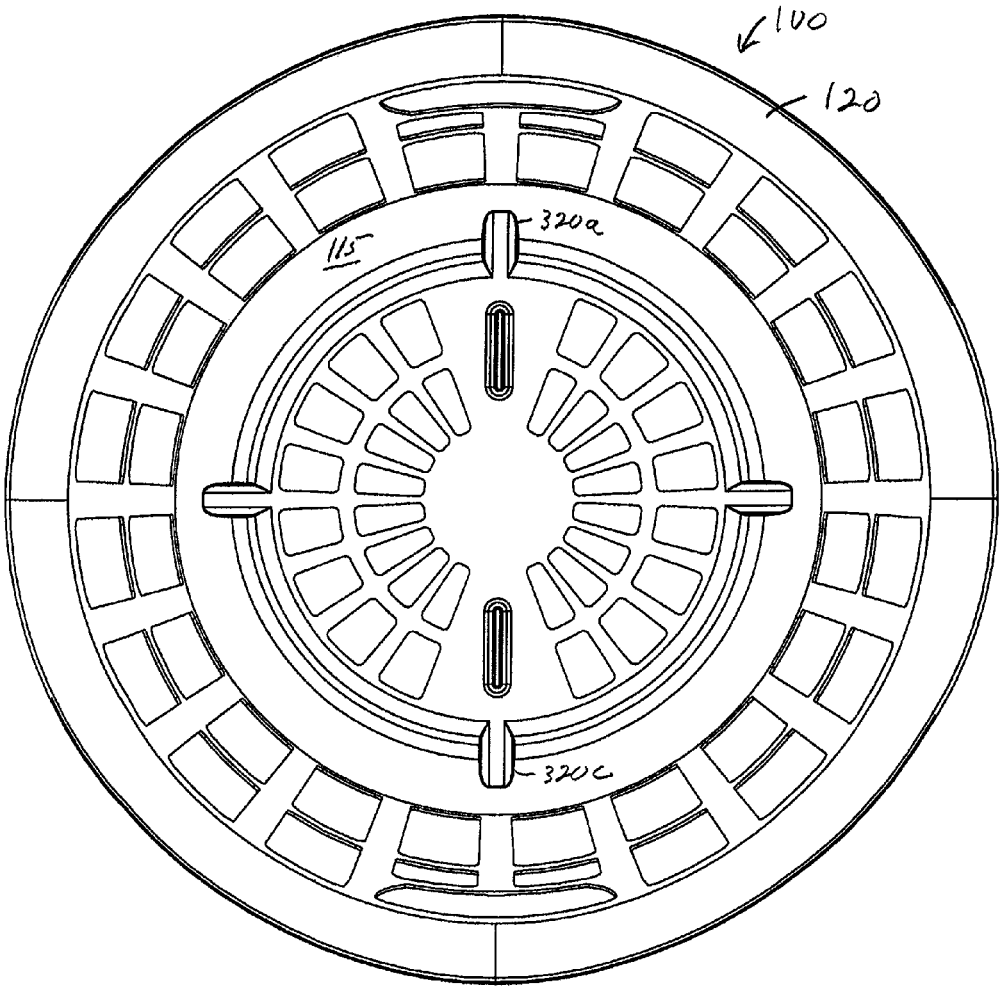
FIG. 3A is a top view and FIG. 3B a bottom view of the container of FIG. 1.
Figure 3B:
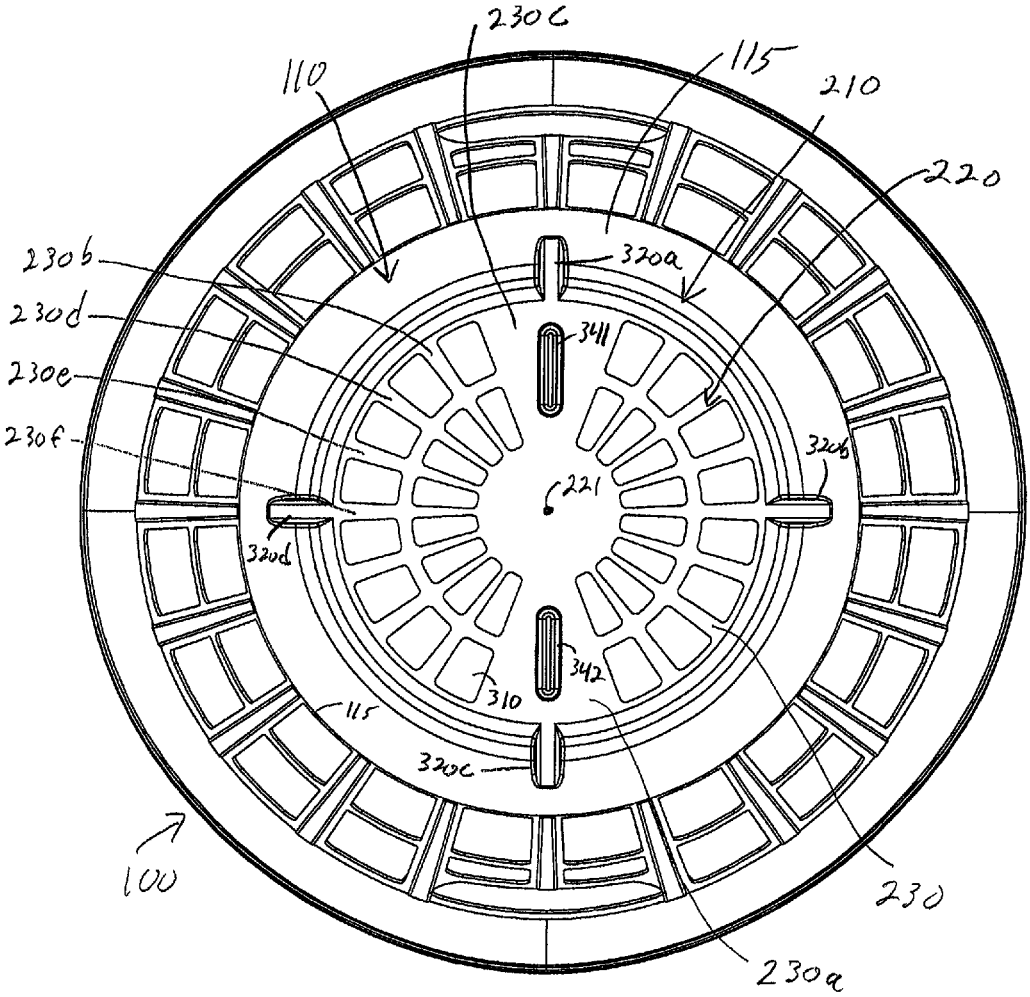
Figure 4:
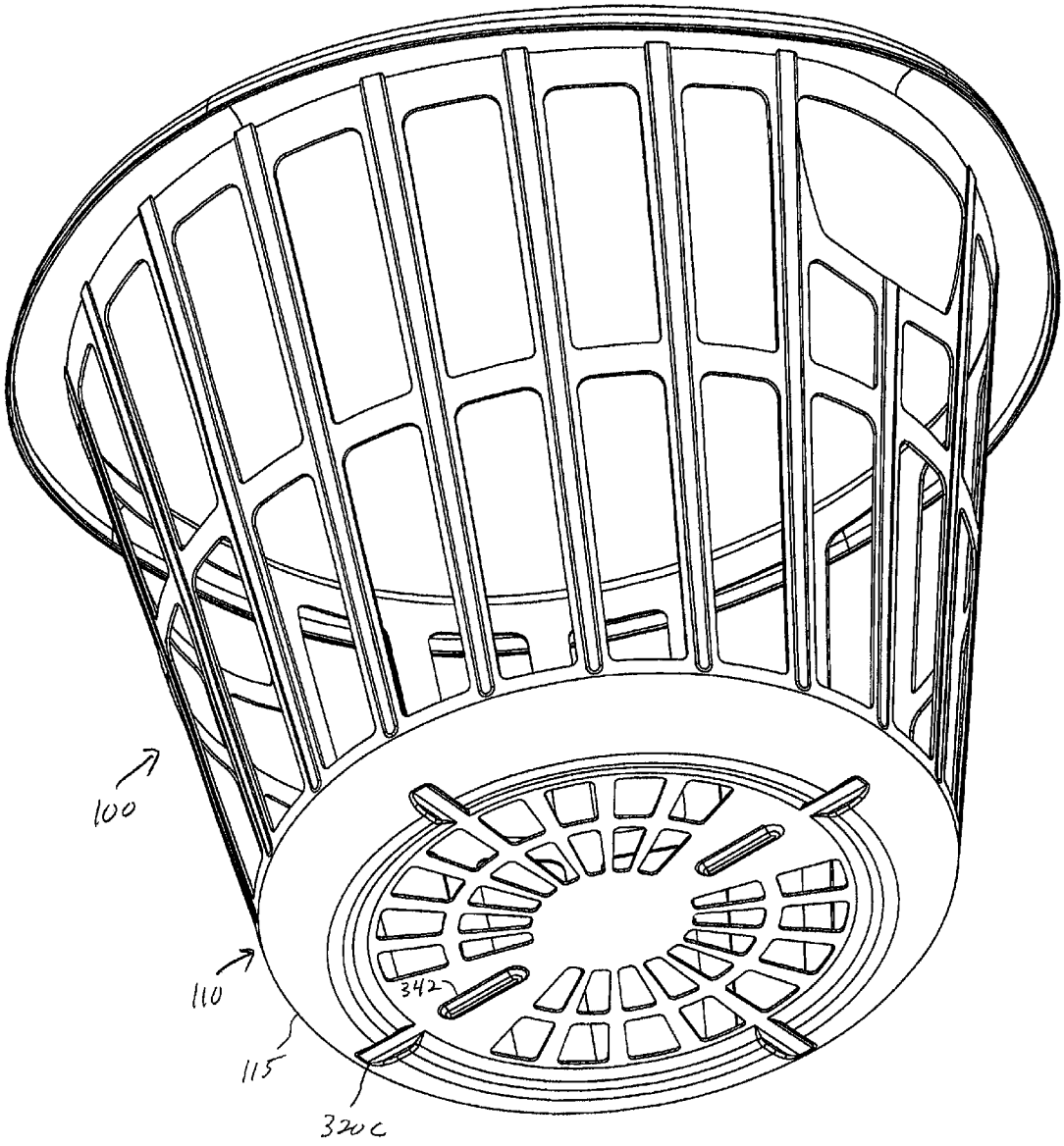
FIG. 4 is a perspective bottom view of the container of FIG. 1.
Figure 5:
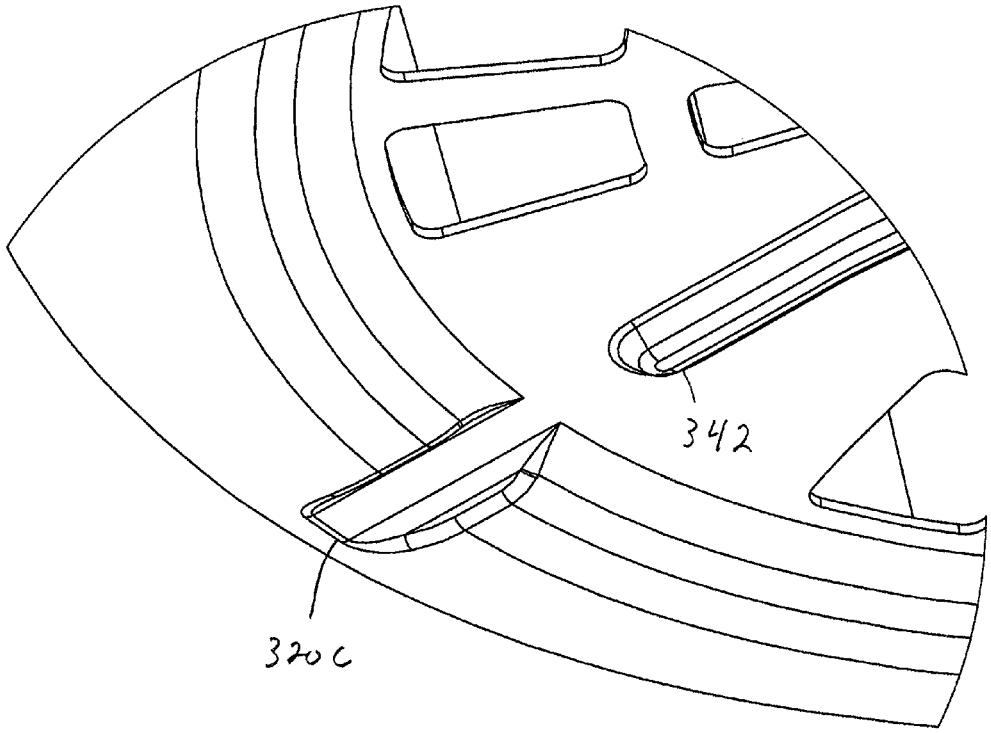
FIG. 5 is a close up view of a vent channel and foot of the container of FIG. 1.
Figure 6:
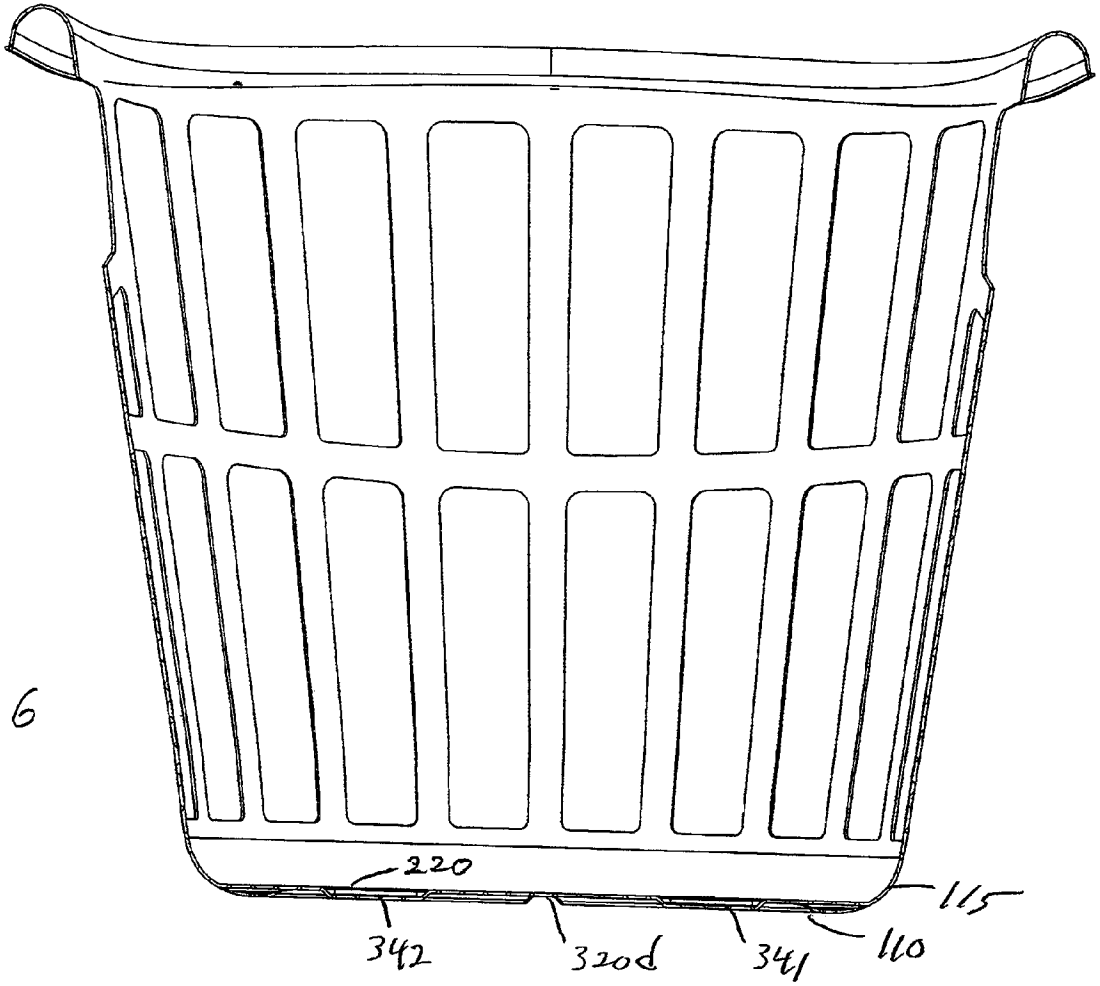
FIG. 6 is a cross-sectional view of the container of FIG. 1.

One example of a ventilated laundry basket or hamper is shown in FIGS. 1 through 6. Basket or hamper 100 is a one-piece integral injection molded plastic container that is generally conical in shape, with an inwardly-tapered sidewall that is truncated by bottom 110. Container 100 also has a top rim or lip 120, a sidewall 130, and an open top 140. In alternate embodiments, basket or hamper 100 may be generally oval or generally rectangular in shape, for example. One such alternative shape is shown and described below.

Sidewall 130 is contiguous with, and extends between, bottom 110 and top rim 120. Sidewall 130 may define a plurality of apertures or openings 135 spaced throughout the sidewall to facilitate air flow into and out of the basket 100. Sidewall 130 may also define larger openings 150 that together with top rim 120 define one or more handholds 160 for the hands of a user to enter to grip the basket 100.

Bottom 110 of basket 100 defines an outer periphery 115 and two generally circular, concentric regions or sections located interiorly of periphery 115; first more outer section or region 210, and second inner section or region 220 that is surrounded by region 210. First region 210 is configured and adapted to be in contact with the floor or other relatively flat surface 1000 that the basket 100 is placed upon. Second region 220 is interior to, and substantially surrounded by, first region 210. Second region 220 is configured and adapted to sit just above the floor or other surface 1000 that basket 100 is placed upon. In one non-limiting embodiment, second region 220 is configured to sit approximately 0.125 inches above the floor or other surface 1000. In alternate embodiments, second region 220 may be configured to sit between approximately 0.10 inches and 1 inch above the floor or other surface 1000.

In one example, second region 220 defines the majority of the bottom 110 of basket 100 and defines a plurality of ribs 230. Ribs 230 may radiate from the approximate center 221 of bottom 110. The ribs 230 may be of varying thickness. In one embodiment, ribs 230*a* and 230*c* are relatively wider than ribs 230*b*, 230*d*, 230*e*, and 230*f*. The spaces between ribs 230 define openings 310 in bottom 110.

One or more vent channels 320 are formed in the outer periphery 115 of bottom 110. In the embodiment shown in FIGS. 1-6 there are four vent channels 320*a-d* that are equally spaced around the periphery of the bottom. Vent channels 320 may be radially aligned with one or more of the ribs 230, specifically where a rib 230 meets first section 210. The upper surface of the vent channels may be on the same plane as the ribs, such that the two are formed by a contiguous surface. Since this level is above the lowest surface (i.e., outer region 210) of bottom 110, the vent channels define an opening that passes through region 210; this allows air to pass between the outside and inner region 220, and thus into and out of the inside of basket 100 through openings 310.

Second section 220 and ribs 230 are configured and adapted to sit above the floor or surface 1000, and is in part supported by integral feet 341 and 342 that sit on the floor or surface 1000. First section 210 is along the same plane as the bottom of the feet and is also configured to rest up on the floor or surface 1000. The tops of the vent channels 320, therefore, are also raised above the surface of the floor or surface 1000, and provide a path through the outer periphery 115 and the first section 210 through which ambient air can flow under basket 100, and into the basket through the openings in the bottom and then through the contents of the basket. In one embodiment, four vent channels are formed in the bottom 110 of basket 100. In alternate embodiments, basket 100 may be configured with any number of vent channels. The vent channels do not need to lie along radii.

Basket 100 is preferably made of molded plastic, although this is not a limitation of the invention.

Figure 7:
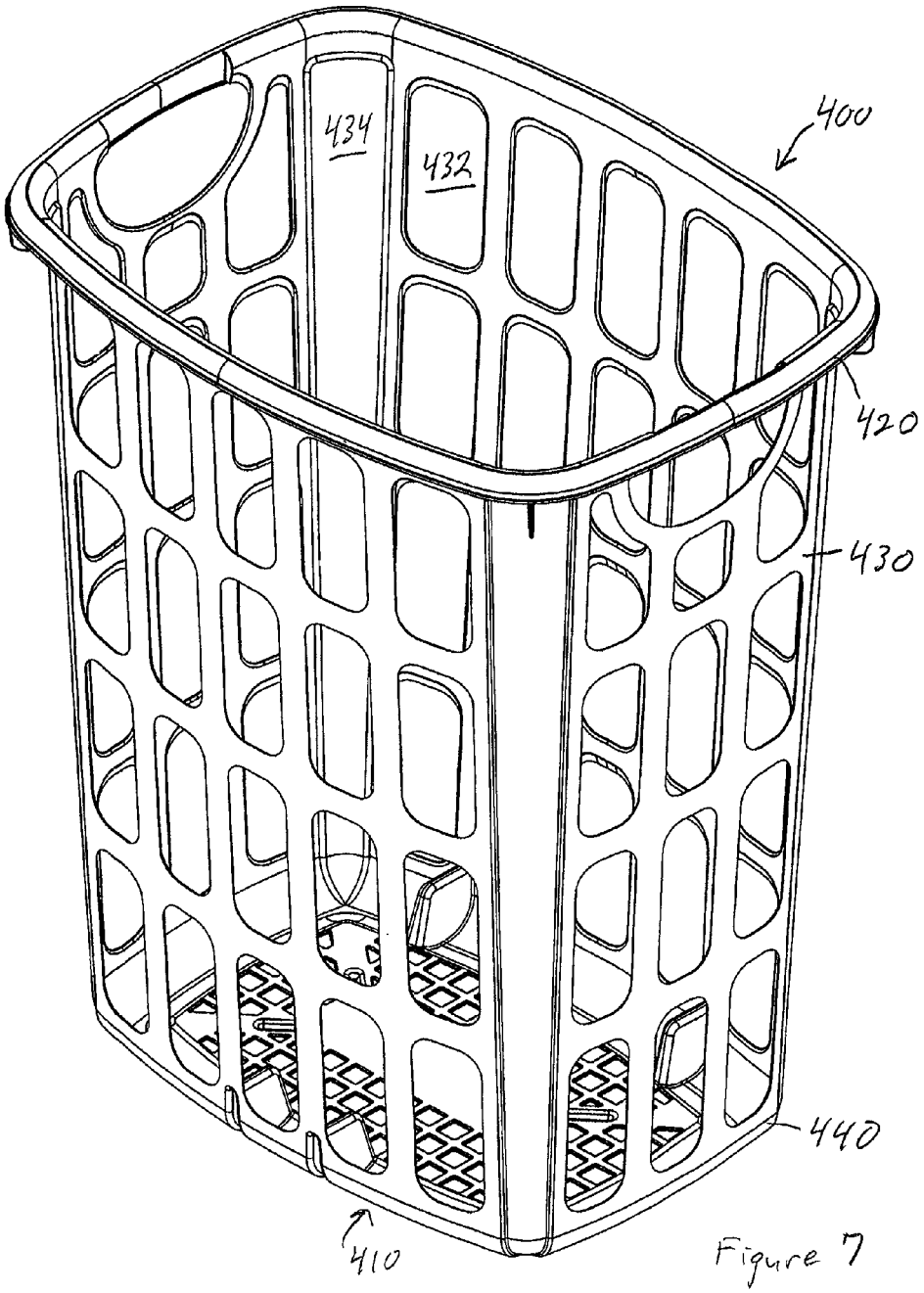
FIG. 7 is a perspective view of a second example of a container of this disclosure.
Figure 8A:
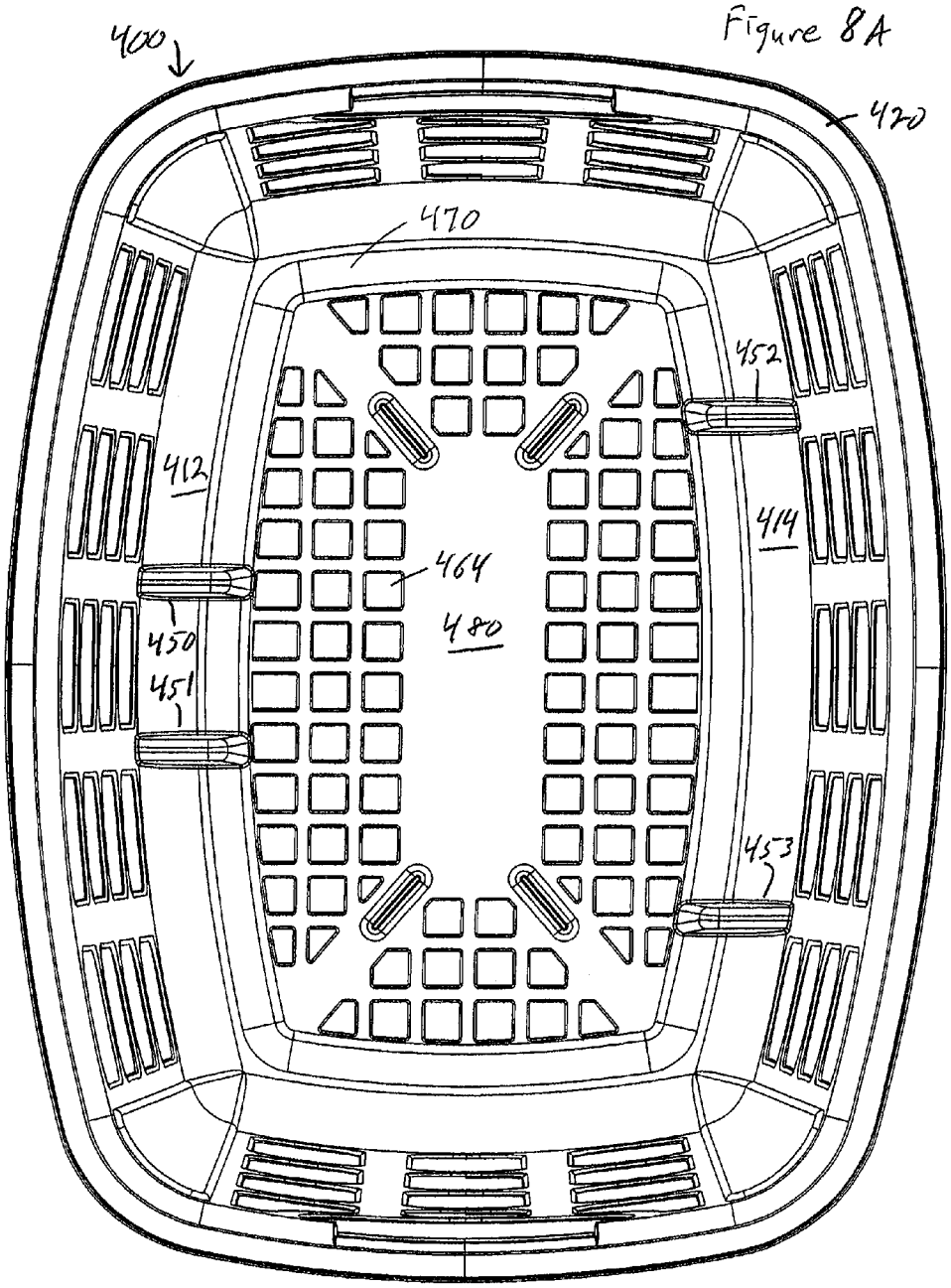
FIG. 8A is a top view and FIG. 8B a bottom view of the container of FIG. 7.
Figure 8B:
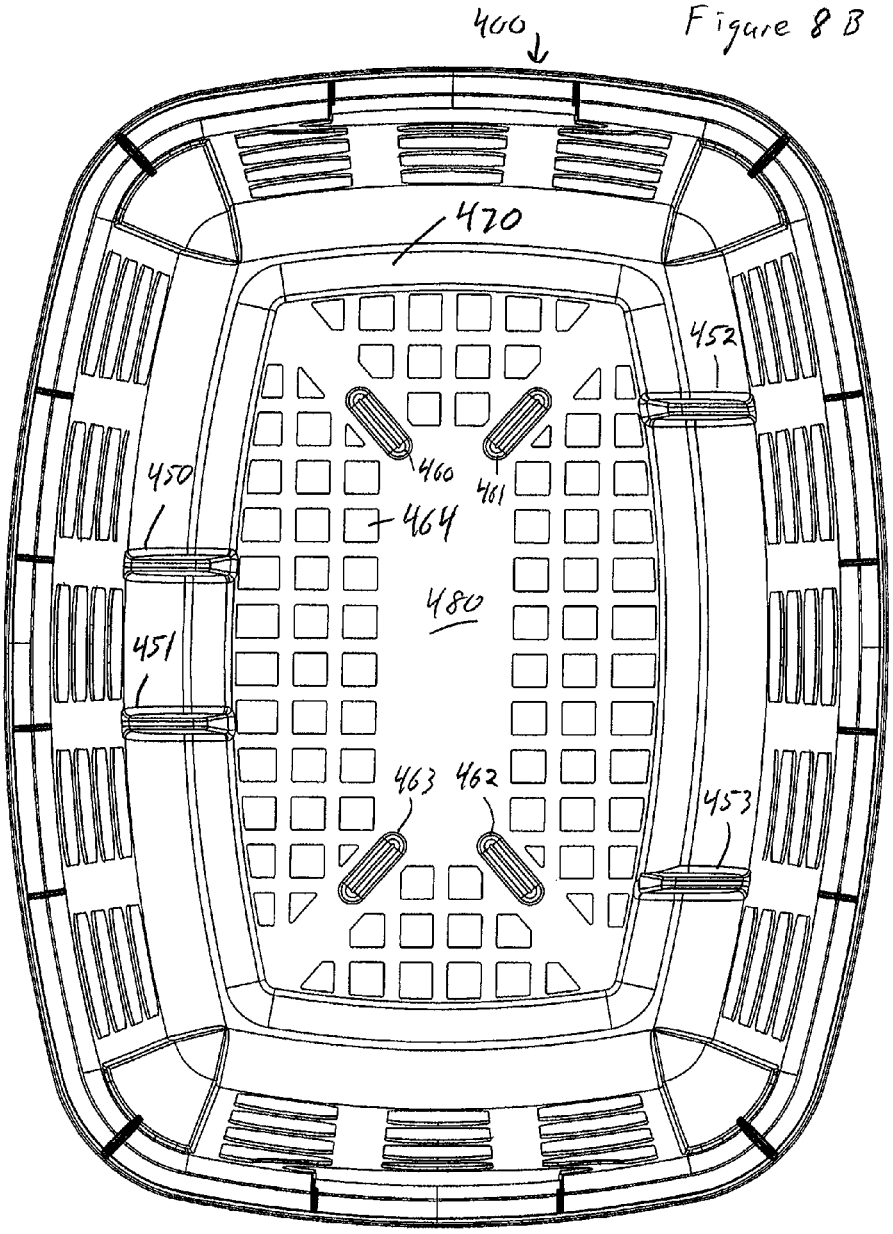
Figure 9A:
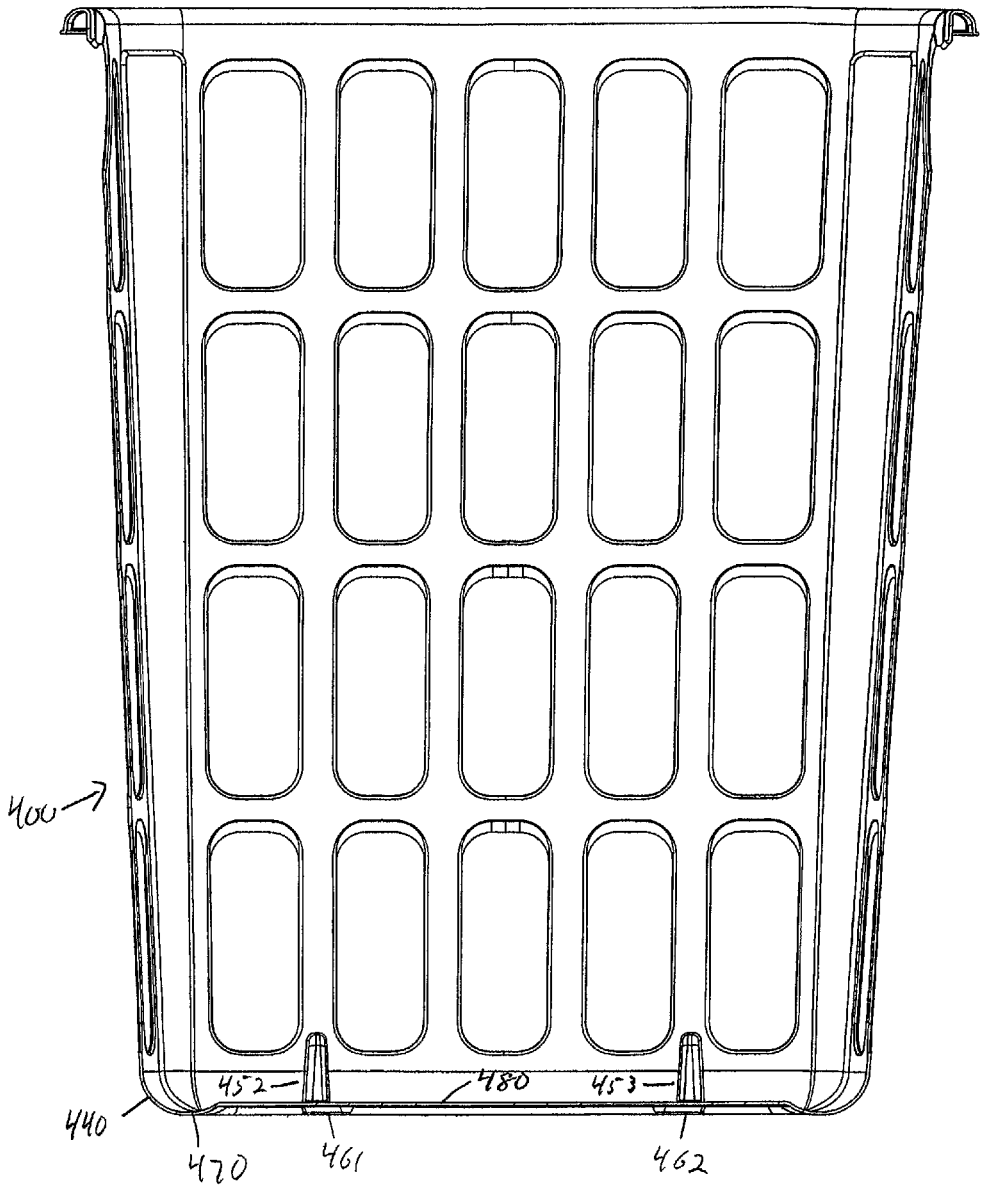
FIG. 9A is a cross-sectional view of the container of FIG. 7.
Figure 9B:
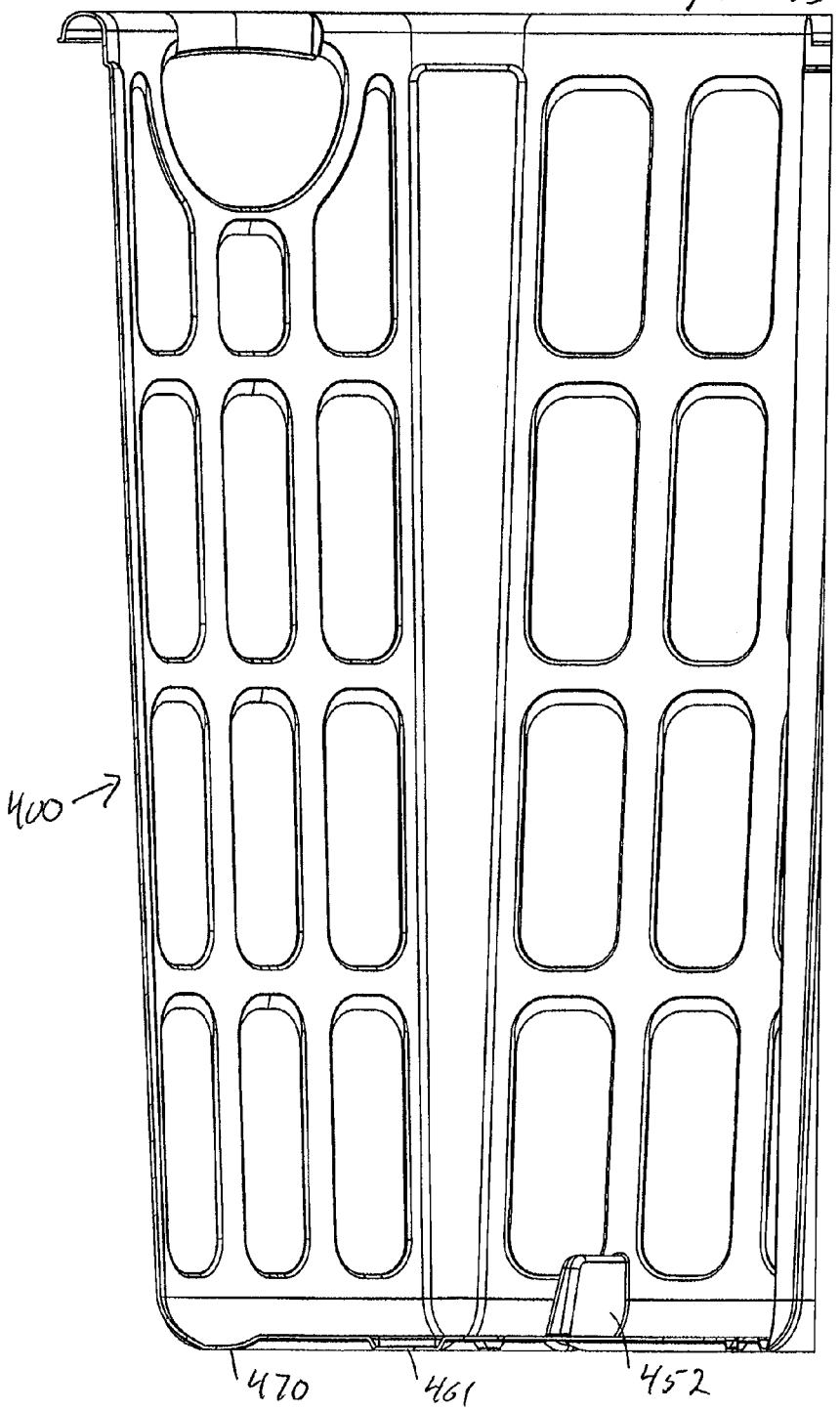
FIG. 9B is a different cross-sectional view of the container of FIG. 7.
Figure 10:
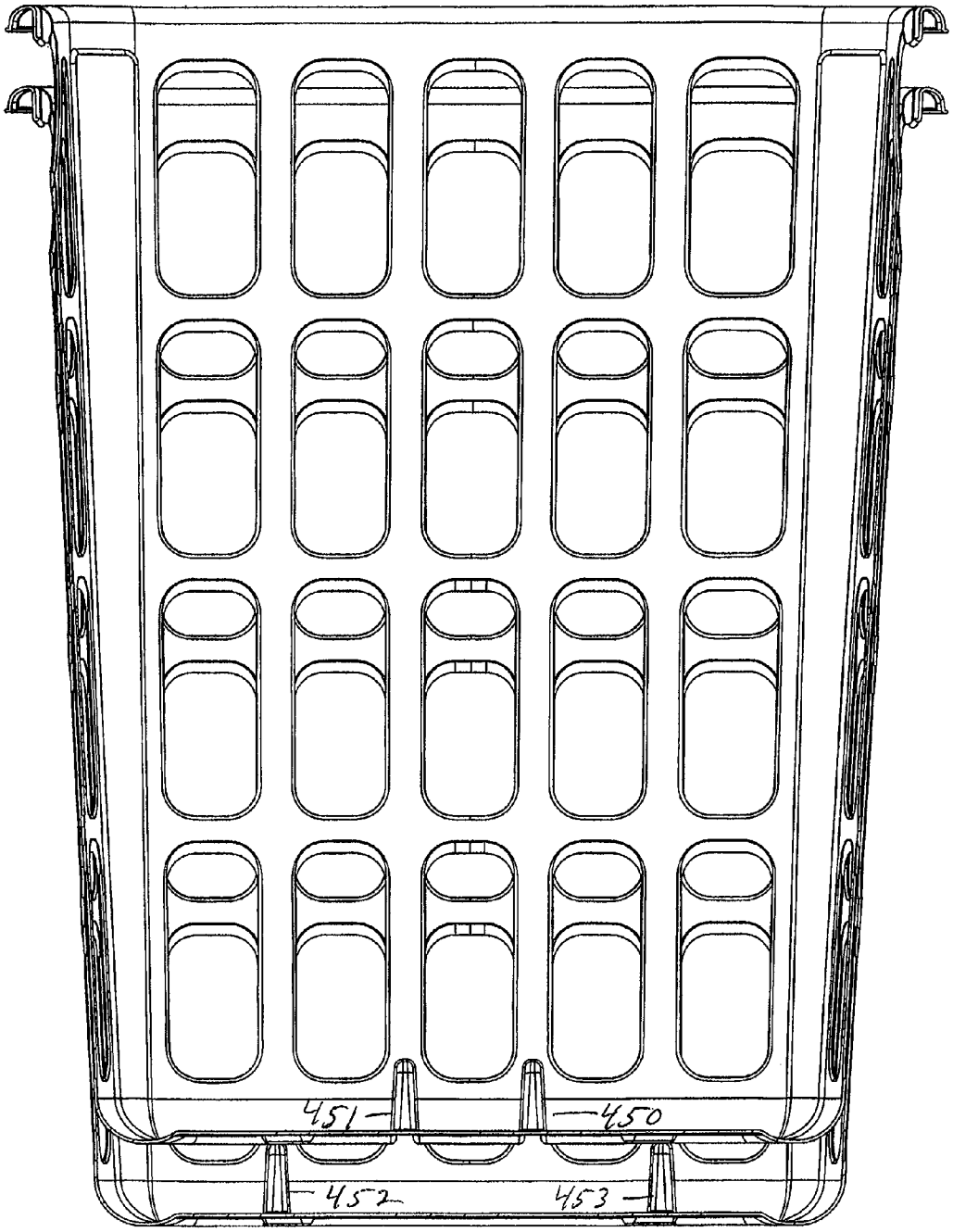
FIG. 10 is a cross-sectional view showing two of the containers of FIG. 7 nested together for storage.

A second example of the laundry basket or hamper is shown in FIGS. 7-10. Generally rectangular hamper 400 has sidewall 430 with openings 432 and four corners 434, top lip 420, bottom 410 and curved or radiused bottom to sidewall transition region 440. Bottom 410 has outer region 470 that sits on the floor and surrounds raised inner region 480 that is supported above the floor by downwardly-projecting feet 460-463. Vent channels 450-453 conduct air through region 440 and region 470 and to region 480 which has openings 464.

Vent channels 450 and 451 lie along parallel longitudinal axes that are generally perpendicular to long side 412 of bottom 410. Similarly, vent channels 452 and 453 lie along parallel longitudinal axes that are generally perpendicular to opposite long side 414 of bottom 410. The two pairs of vent channels are not co-linear. As a result, two or more baskets 400 that are oriented such that side 412 is above side 414 can be nested together with the bottom of the upper hamper sitting on the tops of the vent channels of the hamper below it; see FIG. 10.

Other features will occur to those skilled in the field and are within the scope of the claims.

What is claimed is:

1. A one-piece molded basket, comprising:

a bottom having an outer periphery and an inner section that has a number of openings and is interior to, and completely surrounded by, the outer periphery which defines a generally rectangular shape with two opposed, generally parallel long sides and two opposed, generally parallel short sides;

wherein the outer periphery is constructed and arranged to rest on a relatively flat surface, the outer periphery defining a lower plane configured to be disposed substantially on and parallel to the relatively flat surface;

wherein the inner section has a flat bottom surface that is located entirely above the lower plane of the outer periphery such that the inner section is above the flat surface when the outer periphery is on the flat surface;

a pair of indented generally linear vent channels with two vent channels in each long side of the periphery, each channel defining a corresponding opening which extends through the outer periphery and leads to the inner section, each of the pairs of vent channels having a set of walls that surround the opening and extend from the outer periphery along a direction that is substantially perpendicular to the plane defined by the outer periphery, wherein the vent channels are generally shaped as an inverted "U," define an upper surface that lies above the upper surface of the outer periphery, and wherein the pair of vent channels are not co-linear;

a plurality of feet located entirely within the inner section and extending downwardly from the inner section, wherein the feet extend downwardly such that their lowermost extent is at substantially the same level as the lower plane of the outer periphery;

a top rim; and a sidewall contiguous with and extending between the bottom and the top.

2. The basket of claim 1, where the inner section defines one or more ribs that extend from the approximate center of the bottom, and at least one vent channel is radially aligned with at least one of the ribs.

3. The basket of claim 1 wherein the vent channels are generally perpendicular to the portion of the outer periphery through which they pass.

4. The basket of claim 1 wherein the outer periphery defines a rounded outer contour.

5. The basket of claim 4 wherein the vent channels define a generally flat top.

6. The basket of claim 1 wherein vent channels define generally vertical sidewalls and a generally flat top.

7. The basket of claim 1 wherein the feet lie along radii from a center of the bottom.

8. The basket of claim 1 further comprising a plurality of upstanding structures in the outer periphery that project above the bottom such that they support the bottom of an identical basket, while defining an opening, allowing air to pass between the outside and the inner region.

9. The basket of claim 1 wherein the outer periphery defines a generally rectangular shape with two generally parallel long sides and two generally parallel short sides, and there are at least two vent channels in each long side.

10. A one-piece molded basket, comprising:

a bottom having an outer periphery and an inner section that has a number of openings and is interior to, and completely surrounded by, the outer periphery which defines a generally rectangular shape with two opposed, generally parallel along sides and two opposed, generally parallel short sides;

wherein the outer periphery is constructed and arranged to rest on a relatively flat surface, the outer periphery defining a lower plane configured to be disposed substantially on and parallel to the relatively flat surface;

wherein the inner section has a flat bottom surface that is located entirely above the lower plane of the outer periphery such that the inner section is above the flat surface when the outer periphery is on the flat surface;

a pair of indented generally linear vent channels with two vent channels in each long side of the outer periphery, each channel defining a corresponding opening which extends through the outer periphery and leads to the inner section, each of the plurality of vent channels having a set of walls that surround the opening and extend from the outer periphery along a direction that is substantially perpendicular to the plane defined by the outer periphery, wherein the vent channels are generally shaped as an inverted "U," define an upper surface that lies above the upper surface of the outer periphery, and wherein the pair of vent channels are not co-linear;

a plurality of feet located entirely within the inner section and extending downwardly from the inner section, wherein the feet extend downwardly such that their lowermost extent is at substantially the same level as the lower plane of the outer periphery;

a top rim;

a sidewall contiguous with and extending between the bottom and the top; and a plurality of upstanding structures in the outer periphery that project above the bottom such that they support the bottom of an identical basket, while defining an opening, allowing air to pass between the outside and the inner region.

* * * * *